US005640851A

United States Patent [19]

Toon et al.

[11] Patent Number: 5,640,851

[45] Date of Patent: Jun. 24, 1997

[54] GAS TURBINE ENGINE COMBUSTION CHAMBER

[75] Inventors: Ian J. Toon, Derby; Jeffrey D. Willis, Coventry, both of England

[73] Assignee: Rolls-Royce plc, London, England

[21] Appl. No.: 537,788

[22] PCT Filed: May 24, 1994

[86] PCT No.: PCT/GB94/01135

§ 371 Date: Oct. 23, 1995

§ 102(e) Date: Oct. 23, 1995

[87] PCT Pub. No.: WO94/28357

PCT Pub. Date: Dec. 8, 1994

[30] Foreign Application Priority Data

May 24, 1993 [GB] United Kingdom ..... 9310690

[51] Int. Cl.[6] ..... F02G 3/00

[52] U.S. Cl. ..... 60/737; 60/746

[58] Field of Search ..... 60/39.36, 39.37, 60/737, 746, 747, 760

[56] References Cited

U.S. PATENT DOCUMENTS

| | | | |
|---|---|---|---|
| 4,455,839 | 6/1984 | Wuchter | 60/737 |
| 5,319,935 | 6/1994 | Toon et al. | 60/746 |
| 5,408,825 | 4/1995 | Foss et al. | 60/737 |
| 5,469,700 | 11/1995 | Corbet et al. | 60/746 |
| 5,475,979 | 12/1995 | Oag et al. | 60/737 |

FOREIGN PATENT DOCUMENTS

| | | |
|---|---|---|
| 473982 | 6/1969 | European Pat. Off. . |
| 0388886 | 9/1990 | European Pat. Off. . |
| 9207221 | 4/1992 | European Pat. Off. . |
| 768040 | 5/1955 | Germany . |
| 1060026 | 2/1967 | United Kingdom . |
| 1462903 | 1/1977 | United Kingdom . |
| 1489339 | 10/1977 | United Kingdom . |

*Primary Examiner*—Charles G. Freay

*Attorney, Agent, or Firm*—Cushman Darby & Cushman IP Group of Pillsbury Madison Sutro, LLP

[57] ABSTRACT

A combustion chamber which has a primary combustion zone and a secondary combustion zone is provided with a plurality of secondary fuel and air mixing ducts arranged around the primary combustion zone. The secondary fuel and air mixing ducts are defined by a pair of annular walls and by a plurality of walls extending radially between the annular walls. Each secondary fuel and air mixing duct has an aperture to direct a fuel and air mixture into the secondary combustion zone. The apertures have the same flow area. Each secondary fuel and air mixing duct has one or more fuel injectors to inject fuel into the upstream end of the secondary fuel and air mixing duct. This arrangement ensures that the fuel/air ratio emitted from each aperture is within 3.0% of the mean fuel/air ratio of all the apertures even though the air flow to the secondary fuel and air mixing ducts is non-uniform

31 Claims, 5 Drawing Sheets

GAS TURBINE ENGINE COMBUSTION CHAMBER

This application claims benefit of international application PCT/GB 94/01135 filed May 24, 1994.

FIELD OF THE INVENTION

The present invention relates to a gas turbine engine combustion chamber.

BACKGROUND OF THE INVENTION

In order to meet the emission level requirements, for industrial low emission gas turbine engines, staged combustion is required in order to minimise the quantity of the oxides of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature, and this requires premixing of the fuel and all the combustion air before combustion takes place. The oxides of nitrogen (NOx) are commonly reduced by a method which uses two stages of fuel injection. Our UK patent no. 1489339 discloses two stages of fuel injection to reduce NOx. Our International patent application no. WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low i.e. less than the stoichiometric ratio. In order to achieve the required low emissions of NOx and CO it is essential to mix the fuel and air uniformly so that it has less than a 3.0% variation from the mean concentration before the combustion takes place.

The industrial gas turbine engine disclosed in our International patent application no. WO92/07221 uses a plurality of tubular combustion chambers, whose longitudinal axes are arranged in generally radial directions. The inlets of the tubular combustion chambers are at their radially outer ends, and transition ducts connect the outlets of the tubular combustion chambers with a row of nozzle guide vanes to discharge the hot exhaust gases axially into the turbine sections of the gas turbine engine. Each of the tubular combustion chambers has an annular secondary fuel and air mixing duct which surrounds the primary combustion zone. A plurality of equi-spaced secondary fuel injectors are arranged to inject fuel into the upstream end of the annular secondary fuel and air mixing duct. The annular secondary fuel and air mixing duct has a plurality of equi-spaced outlet apertures to direct the fuel and air mixture into the secondary combustion zone. Each of the tubular combustion chambers of the three stage variant also has an annular tertiary fuel and air mixing duct which surrounds the secondary combustion zone. A plurality of equi-spaced tertiary fuel injectors are arranged to inject fuel into the upstream end of the annular tertiary fuel and air mixing duct. The annular tertiary fuel and air mixing duct has a plurality of outlet apertures to direct the fuel and air mixture into the tertiary fuel and air mixing zone.

Unfortunately the flow of air into the tubular combustion chambers is not uniform, this is because of an asymmetric flow of air from a diffuser at the downstream end of the gas turbine engine compressor to the tubular combustion chambers. Each of the secondary fuel injectors passes identical fuel flows and therefore a non uniform fuel and air mixture is created at the points of injection due to the non uniform air flow. The fuel and air mixture directed from the outlet apertures into the secondary combustion zone is non uniform. Similarly the fuel and air mixture directed from the outlet apertures of the tertiary mixing duct into the tertiary combustion zone will be non uniform. This increases the emissions of NOx to above the acceptable levels.

An initial solution for the problem was to redistribute the fuel to match the air mass flow distribution by adjusting the fuel hole sizes of the individual fuel injectors. This requires all of the fuel injectors to be unique in fuel hole diameters and position of the fuel holes to match the air mass flow to achieve the required uniformity of mixing. The air mass flow distribution also varies with the operating power range of the engine. However redistributing the fuel to match the air mass flow distribution would not achieve the required 3.0% variation in concentration uniformity at all powers and hence emissions of NOx would be above the acceptable levels.

Another solution for the problem was to fit air guidance devices upstream of the secondary fuel and air mixing duct, and tertiary fuel and air mixing duct, to create a uniform air mass flow at the intakes of the secondary fuel and air mixing duct, and tertiary fuel and air mixing duct. Unfortunately any minor changes in the air guidance devices formed during the production processes result in relatively large changes in air mass flow distribution i.e. greater than the 3.0% variation in concentration uniformity.

A further solution for the problem was to redistribute the air mass flow upstream of the intakes of the secondary fuel and air mixing duct, and tertiary fuel and air mixing duct, using a flow distributor which uses its pressure drop to create uniform flow through each of its flow routes. Unfortunately an increase in system pressure drop is not acceptable because this reduces the surge margin of the compressor and also reduces the thermal efficiency of the engine i.e. increases the engine fuel consumption.

The only acceptable solution therefore must be tolerant to upstream air flow variations without increasing the system pressure loss.

EPO388886A discloses a combustor for burning of fuel by premixing fuel with air in a number of premix flame forming nozzles which inject the premixed fuel and air into a secondary combustion zone. Fuel injectors are provided to inject fuel into the premix flame forming nozzles downstream of the intakes of the premix flame forming nozzles.

The present invention seeks to provide a novel gas turbine engine combustion chamber which overcomes the above mentioned problem.

Accordingly the present invention provides a gas a turbine engine combustion chamber comprising a primary combustion zone defined by at least one peripheral wall and an upstream end wall connected to the upstream end of the at least one peripheral wall, the upstream end wall has at least one aperture, primary air intake means and primary fuel injector means to supply air and fuel respectively through the at least one aperture into the primary combustion zone, a secondary combustion zone in the interior of the combustion chamber downstream of the primary combustion zone, means to define a plurality of secondary fuel and air mixing ducts, each secondary fuel and air mixing duct has an outlet at its downstream end for discharging the fuel and air mixture into the secondary combustion zone, each secondary fuel and air mixing duct has secondary air intake means at its upstream end to supply air into the secondary fuel and air mixing duct, each secondary fuel and air mixing duct has secondary fuel injector means arranged to supply fuel into the secondary fuel and air mixing duct, each secondary fuel injector means is located downstream of the secondary air intake means of the associated secondary fuel and air mixing duct, the outlets of the secondary fuel and air mixing ducts have substantially equal flow areas to produce substantially the same air flow rate through each of the secondary fuel and air mixing ducts, the secondary fuel injector means of each secondary fuel and air mixing duct is arranged to supply substantially the same flow rate of fuel so that the fuel to air ratio of the mixture leaving each of the secondary fuel and air mixing ducts is substantially the same.

Preferably the secondary fuel and air mixing ducts radially inwardly of the primary combustion zone, the secondary fuel and air mixing ducts are defined at their radially inner extremity and radially outer extremity by a second pair of walls and a plurality of walls extending radially between the second pair of annular walls.

Preferably at least one of the secondary fuel injector means comprises a hollow cylindrical member, the hollow cylindrical member has a plurality of apertures spaced apart axially along the cylindrical member to inject fuel into the secondary fuel and air mixing duct.

The hollow cylindrical member may extend axially with respect to the axis of the combustion chamber. The hollow cylindrical member may extend radially with respect to the axis of the combustion chamber. The apertures in the hollow cylindrical member may be arranged to direct the fuel circumferentially.

Preferably the walls extending radially between the annular walls are secured to both the annular walls.

Preferably the secondary fuel injector means for at least one of the secondary fuel and air mixing ducts comprises two secondary fuel injectors. The two secondary fuel injectors may be spaced apart circumferentially relative to the axis of the combustion chamber. Preferably each secondary fuel injector is arranged to supply fuel to the upstream end of the associated secondary fuel and air mixing duct.

Preferably the combustion chamber includes means to define a plurality of tertiary fuel and air mixing ducts, each tertiary fuel and air mixing duct is in fluid communication at its downstream end with a tertiary combustion zone in the interior of the combustion chamber downstream of the secondary combustion zone, each tertiary fuel and air mixing duct has tertiary air intake means at its upstream end to supply air into the tertiary fuel and air mixing duct, each tertiary fuel and air mixing duct has tertiary fuel injector means arranged to inject fuel into the tertiary fuel and air mixing duct, the tertiary fuel and air mixing ducts are arranged in an annulus outside the peripheral wall, each tertiary fuel injector means is located downstream of the tertiary air intake means of the associated tertiary fuel and air mixing duct, each tertiary fuel and air mixing duct has an outlet at its downstream end for discharging the fuel and air mixture into the tertiary combustion zone, the outlets of the tertiary fuel and air mixing ducts have substantially equal flow areas to produce substantially the same air flow rate through each of the tertiary fuel and air mixing ducts, the tertiary fuel injector means of each tertiary fuel and air mixing duct is arranged to supply substantially the same flow rate of fuel so that the fuel to air ratio of the mixture leaving each of the tertiary fuel and air mixing ducts is substantially the same.

Preferably the tertiary fuel and air mixing ducts are defined by a radially inner annular wall, a radially outer annular wall and a plurality of walls extending radially between the pair of annular walls, the radially extending walls are secured to at least one of the pair of annular walls.

Preferably the tertiary fuel and air mixing ducts are arranged around the combustion chamber.

The combustion chamber may be tubular, the peripheral wall of the primary combustion zone is annular and the upstream end wall has a single aperture, the plurality of tertiary fuel and air mixing ducts are arranged circumferentially in an annulus radially outwardly of the secondary combustion zone.

Preferably at least one of the tertiary fuel injector means comprises a hollow cylindrical member, the hollow cylindrical member has a plurality of apertures spaced apart axially along the cylindrical member to inject fuel into the tertiary fuel and air mixing duct.

The hollow cylindrical member may extend axially with respect to the axis of the combustion chamber. The hollow cylindrical member may extend radially with respect to the axis of the combustion chamber. The apertures in the hollow cylindrical member may be arranged to direct the fuel circumferentially.

Preferably the tertiary fuel injector means for at least one of the tertiary fuel and air mixing ducts comprises two tertiary fuel injectors. The two tertiary fuel injectors may be spaced apart axially relative to the axis of the combustion chamber. The two tertiary fuel injectors may be spaced apart circumferentially relative to the axis of the combustion chamber.

The present invention also provides a gas turbine engine combustion chamber comprising a primary combustion zone defined by at least one peripheral wall and an upstream end wall connected to the upstream end of the at least one peripheral wall, the upstream end wall has at least one aperture, primary air intake means and primary fuel injector means to supply air and fuel respectively through the at least one aperture into the primary combustion zone, a secondary combustion zone defined by a downstream portion of the at least one peripheral wall, the secondary combustion zone is in the interior of the combustion chamber downstream of the primary combustion zone, secondary air intake means and secondary fuel injector means to supply air and fuel respectively into the secondary combustion zone, means to define a plurality of tertiary fuel and air mixing ducts, each tertiary fuel and air mixing duct is in fluid flow communication at its downstream end with a tertiary combustion zone in the interior of the combustion chamber downstream of the secondary combustion zone, each tertiary fuel and air mixing duct has tertiary air intake means at its upstream end to supply air into the tertiary fuel and air mixing duct, each tertiary fuel and air mixing duct has tertiary fuel injector means arranged to supply fuel into the tertiary fuel and air mixing duct, each tertiary fuel injector means is located downstream of the tertiary air intake means of the associated tertiary fuel and air mixing duct, each tertiary fuel and air mixing duct has an outlet at its downstream end for discharging the fuel and air mixture into the tertiary combustion zone, the outlets of the tertiary fuel and air mixing ducts have substantially equal flow areas to produce substantially the same air flow rate through each of the tertiary fuel and air mixing ducts, the tertiary fuel injector means of each fuel and air mixing duct is arranged to supply substantially the same flow rate of fuel so that the fuel to air ratio of the mixture leaving each of the tertiary fuel and air mixing ducts is substantially the same.

Preferably the tertiary fuel and air mixing ducts are arranged around the combustion chamber.

Preferably the tertiary fuel and air mixing ducts are arranged in an annulus outside the peripheral wall, the tertiary fuel and air mixing ducts are defined by a radially inner annular wall, a radially outer annular wall and a plurality of walls extending radially between the pair of annular walls, the radially extending walls are secured to at least one of the pair of annular walls.

The present invention will be more fully described by way of example with reference to the accompanying drawings, in which.

Figure 1:
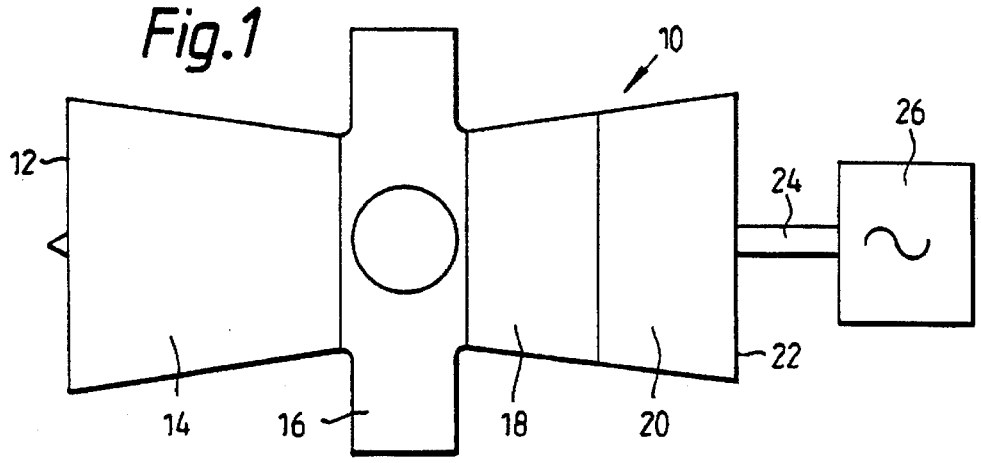
FIG. 1 is a view of a gas turbine engine having a combustion chamber assembly according to the present invention.
Figure 2:
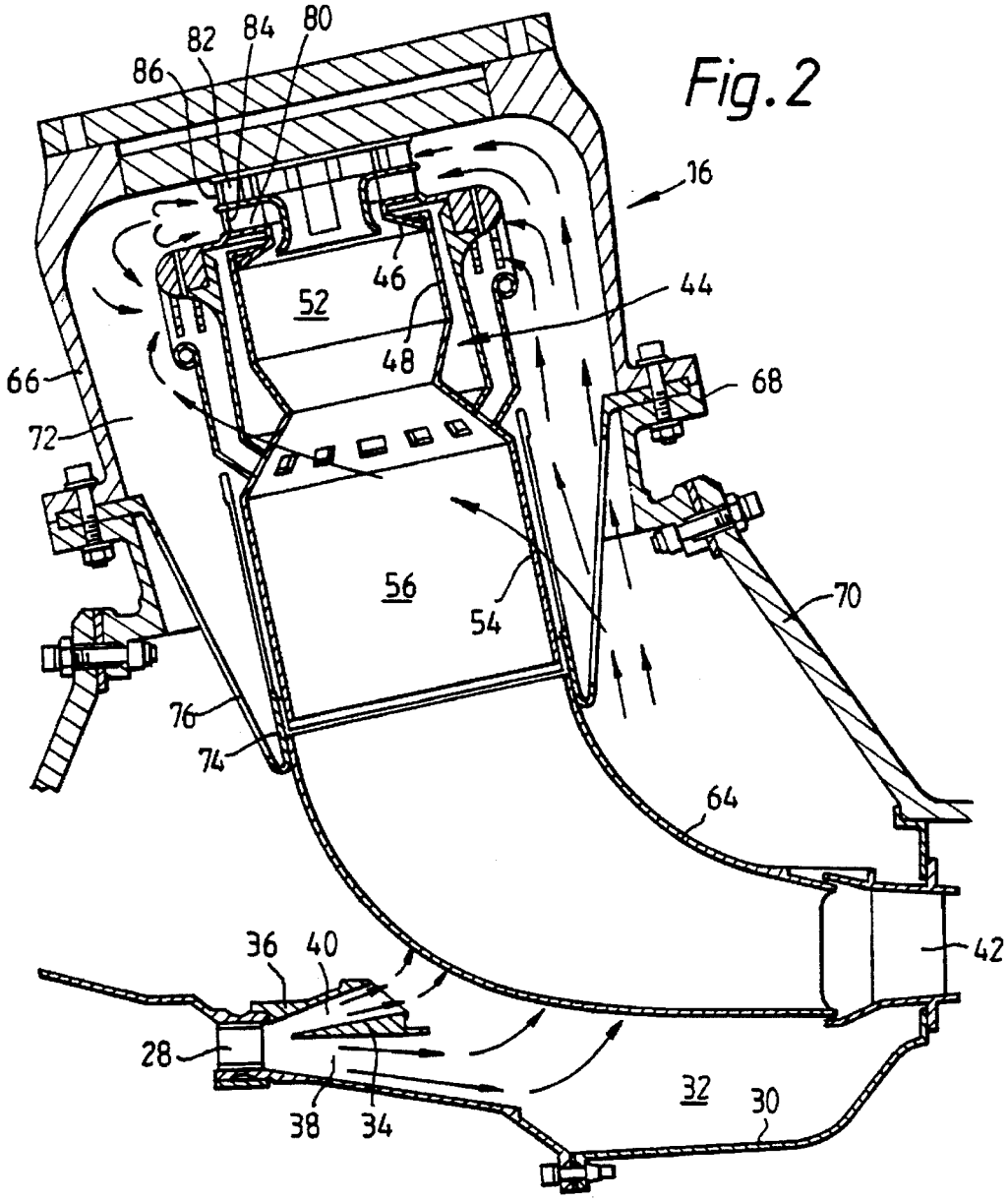
FIG. 2 is an enlarged longitudinal cross-sectional view through the combustion chamber shown in FIG. 1.
Figure 3:
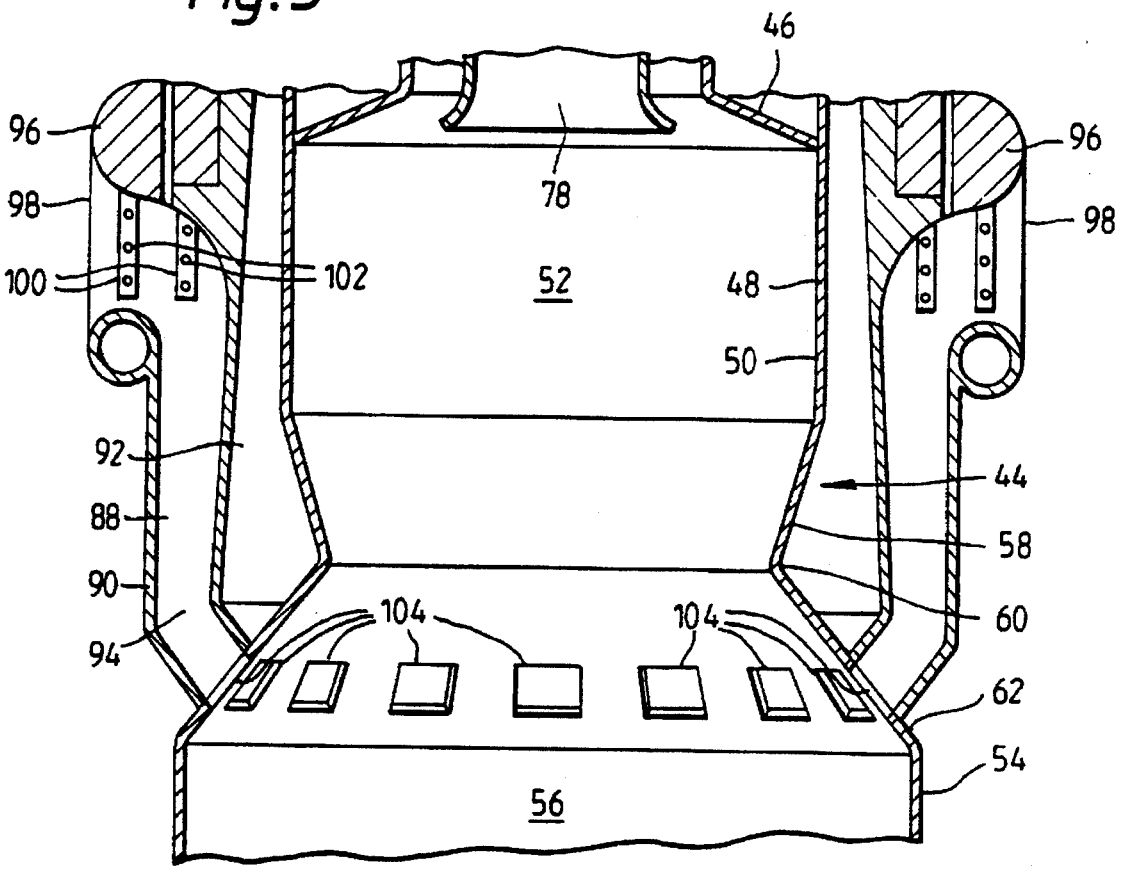
FIG. 3 is a further enlarged longitudinal cross-sectional view through the upstream end of the combustion chamber assembly shown in FIG. 2.
Figure 4:
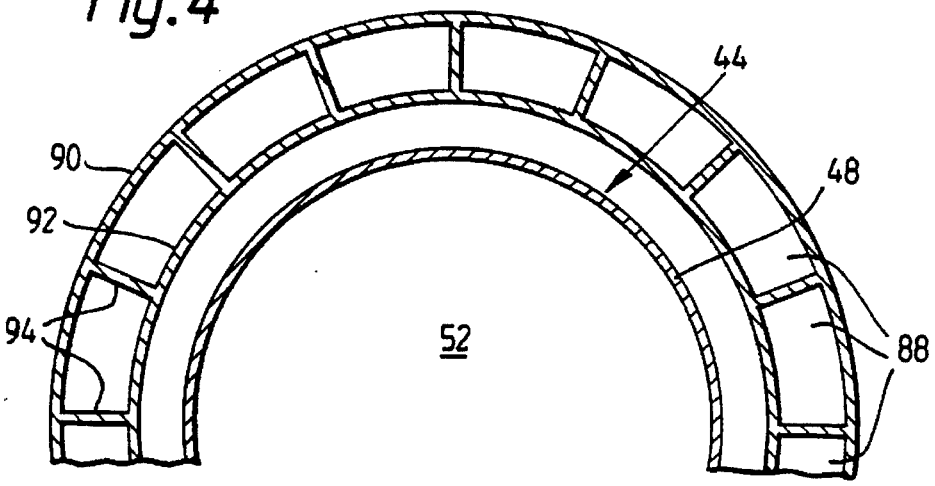
FIG. 4 is a cross-sectional view in the direction of arrows A—A in FIG. 3.
Figure 5:
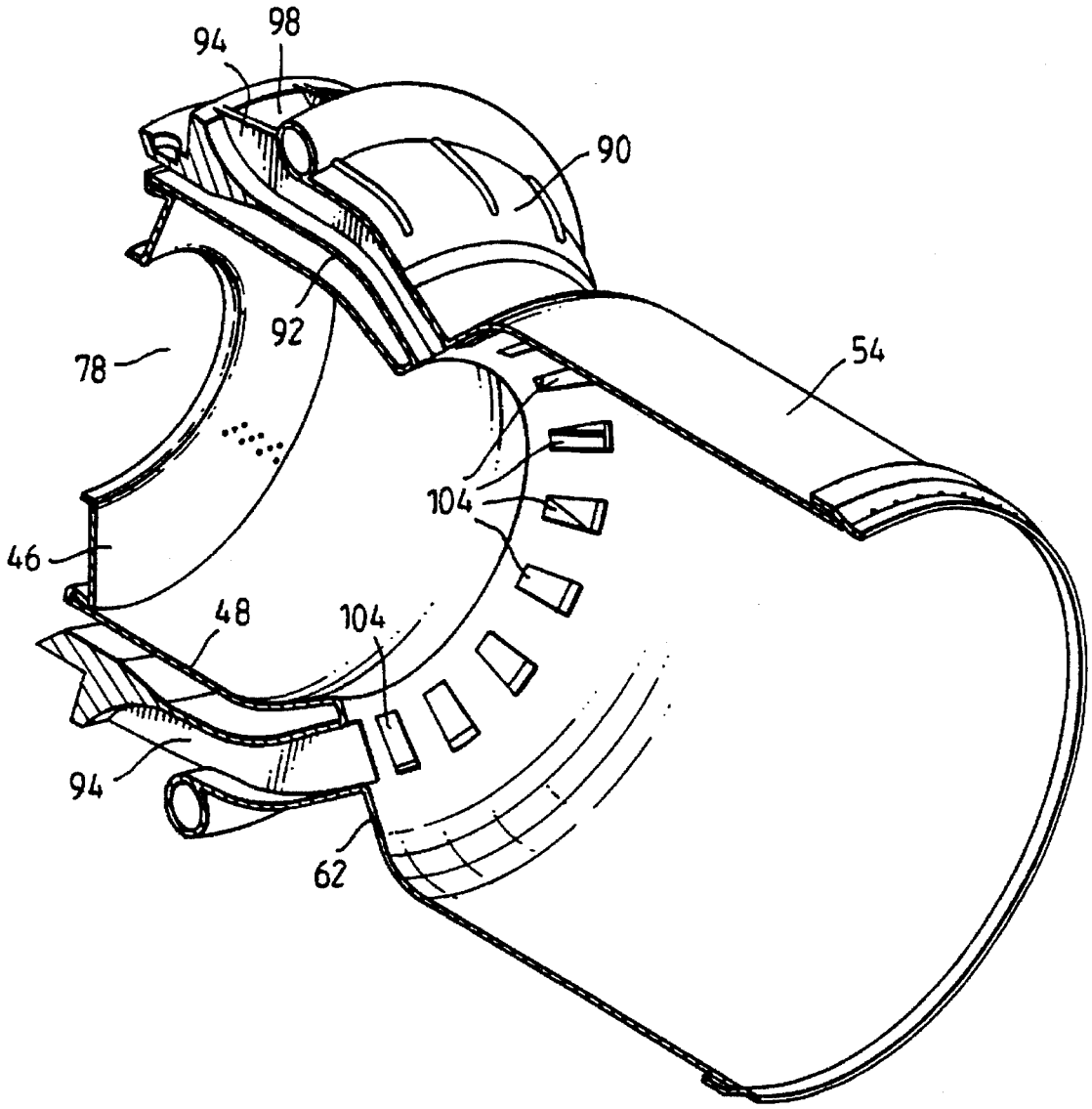
FIG. 5 is a cross-sectional perspective view of the combustion chamber assembly shown in FIG. 2.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 18 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine 10 is quite conventional, and will not be discussed further.

The Combustion chamber assembly 16 is shown more clearly in FIGS. 2 to 5. A plurality of compressor outlet guide vanes 28 are provided at the axially downstream end of the compressor section 14, to which is secured at their radially inner ends an inner annular wall 30 which defines the inner surface of an annular chamber 32. A first passage 38 of a split diffuser is defined between an annular wall 34 and the upstream end of the inner annular wall 30 and a second passage 40 of the split diffuser is defined between the annular wall 34 and a further annular wall 36. The downstream end of the inner annular wall 30 is secured to the radially inner ends of a row of nozzle guide vanes 42 which direct hot gases from the combustion chamber assembly 16 into the turbine section 18.

The combustion chamber assembly 16 comprises a plurality of, for example nine, equally circumferentially spaced tubular combustion chambers 44. The axes of the tubular combustion chambers 44 are arranged to extend in generally radial directions. The inlets of the tubular combustion chambers 44 are at their radially outermost ends and their outlets are at their radially innermost ends.

Each of the tubular combustion chambers 44 comprises an upstream wall 46 secured to the upstream end of an annular wall 48. A first, upstream, portion 50 of the annular wall 48 defines a primary combustion zone 52, and a second, downstream, portion 54 of the annular wall 48 defines a secondary combustion zone 56. The second portion 54 of the annular wall 48 has a greater diameter than the first portion 50. The downstream end of the first portion 50 has a frustoconical portion 58 which reduces in diameter to a throat 60. A third frustoconical portion 62 interconnects the throat 60 at the downstream end of the first portion 50 and the upstream end of the second portion 54.

A plurality of equally circumferentially spaced transition ducts 64 are provided, and each of the transition ducts 64 has a circular cross-section at its upstream end. The upstream end of each of the transition ducts 64 is located coaxially with the downstream end of a corresponding one of the tubular combustion chambers 44, and each of the transition ducts 64 connects and seals with an angular section of the nozzle guide vanes 42.

A plurality of cylindrical casings 66 are provided, and each cylindrical casing 66 is located coaxially around a respective one of the tubular combustion chambers 44. Each cylindrical casing 66 is secured to a respective boss 68 on an annular engine casing 70. A number of chambers 72 are formed between each tubular combustion chamber 44 and its respective cylindrical casing 66.

The upstream end of each transition duct 64 and the downstream end of a corresponding tubular combustion chamber 44 are located in a respective annular mounting structure 74 which is secured to one of the bosses 68 by one of the cylindrical casings 66. The annular mounting structure 74 is provided with apertures 76 to allow the flow of air from chamber 32 into the chambers 72.

The upstream wall 46 of each of the tubular combustion chambers 44 has an aperture 78 to allow the supply of air and fuel into the primary combustion zone 52. A first radial flow swirler 80 is arranged coaxially with the aperture 78 in the upstream wall 46 and a second radial flow swirler 82 is arranged coaxially with the aperture 78 in the upstream wall 46. The first radial flow swirler 80 is positioned axially downstream, with respect to the axis of the tubular combustion chamber, of the second radial flow swirler 82. The first radial flow swirler 80 has a plurality of fuel injectors 84, each of which is positioned in a passage formed between two vanes of the swirler. The second radial flow swirler 82 has a plurality of fuel injectors 86, each of which is positioned in a passage formed between two vanes of the swirler. The first and second radial flow swirlers 80 and 82 are arranged such they swirl the air in opposite directions. For a more detailed description of the use of the two radial flow swirlers and the fuel injectors positioned in the passages formed between the swirl vanes see our International Patent Application No WO92/07221. The primary fuel and air is mixed together in the passages between the vanes of the first and second radial flow swirlers 80 and 82.

A plurality of secondary fuel and air mixing ducts 88 are provided for each of the tubular combustion chambers 44. The secondary fuel and air mixing ducts 88 are arranged circumferentially in an annulus around the primary combustion zone 52. Each of the secondary fuel and air mixing ducts is defined between a second annular wall 90, a third annular wall 92 and by walls 94 which extend radially between the second and third annular walls 90 and 92. The second annular wall 90 defines the radially outer extremity of each of the secondary fuel and air mixing ducts 88 and the third annular wall 92 defines the radially inner extremity of each of the secondary fuel and air mixing ducts 88. The walls 94 separate the individual secondary fuel and air mixing ducts 88. The axially upstream end 96 of the third annular wall 92 is curved radially outwardly so that it is spaced axially from the upstream end of the second annular wall 90. The upstream end of the third annular wall 92 is secured to a side plate of the first radial flow swirler 80. Each of the secondary fuel and air mixing ducts 88 has a secondary air intake 98 defined axially between the upstream end of the second annular wall 90, the upstream end of the third annular wall 92 and the upstream ends of the walls 94 which also extend axially between the second and third annular walls 90 and 92 respectively at this position. For example sixteen secondary fuel and air mixing ducts 88 are provided.

A plurality of secondary fuel injectors 100 are provided, at least one secondary fuel injector 100 is provided per secondary fuel and air mixing duct 88. Each of the secondary fuel and air injectors 100 comprises a hollow cylindrical member which extends axially with respect to the tubular combustion chamber 44. Each of the hollow cylindrical members 100 passes through the upstream end of the third annular wall 92 to supply fuel into the upstream end of the secondary fuel and air mixing duct 88. The hollow cylindrical member is provided with a plurality of apertures 102 through which the fuel is injected into the secondary fuel and air mixing duct 88. The apertures 102 are of equal diameters and are spaced apart axially along the hollow cylindrical member at suitable positions, and the apertures 102 in the hollow cylindrical member are arranged at diametrically opposite sides of the hollow cylindrical member so that the fuel injectors 100 are arranged to inject the fuel circumferentially with respect to the axis of the tubular combustion chamber 44. In this example two fuel injectors 100 are provided for each secondary fuel and air mixing duct 88. The secondary fuel injectors are spaced apart circumferentially with respect to the axis of the tubular combustion chamber 44.

Each second and third annular wall 90 and 92 is arranged coaxially around the first portion 50 of the annular wall 48. At the downstream end of each secondary fuel and air mixing duct 88, the second and third annular walls 90 and 92 are secured to the respective third frustoconical portion 62, and each frustoconical portion 62 is provided with a plurality of equi-circumferentially spaced apertures 104 which are arranged to direct fuel and air into the secondary combustion zone 56 in the tubular combustion chamber 44, in a downstream direction towards the axis of the tubular combustion chamber 44. The apertures 104 may be circular or slots. Each of the apertures 104 is arranged to allow the fuel and air mixture from one of the secondary fuel and air mixing ducts 88 to flow into the secondary combustion zone 56. The apertures 104 are of equal flow area.

The operation of the gas turbine combustion chamber is substantially as described in our International Patent Application No WO92/07221 and this should be consulted for a more complete description.

The use of a single annular secondary fuel and air mixing duct in our International Patent Application No WO92/07221 results in an air and fuel mixture which has a variation in concentration of more than 3.0% from the mean concentration and this results in NOx levels greater than 25 volume parts per million (vppm).

The use of a plurality of secondary fuel and air mixing ducts each of which has an aperture into the secondary combustion zone enables the air and fuel mixture to have a variation in concentration less than the 3.0% from the mean concentration and hence results in NOx less than 25 vppm.

The mass flow rate through each secondary fuel and air mixing duct 88 is dominated by the aperture 104 exit area and the pressure drop across it. The exit areas of the apertures 104 are controlled to be within 1.0% more, or less of the required flow area and the upstream velocity/pressure variations are negligible compared to the pressure across the exit area of the aperture 104. This results in the air mass flow entering each secondary fuel and air mixing duct 88 being within 1.0% more, or less, of the mean mass flow through all of the fuel and air mixing ducts 88. Each duct 88 is supplied by two secondary fuel injectors 100, each of which is within 2.0% of the mean area, the overall resultant concentration is within 3.0% of the mean concentration. This arrangement ensures that the fuel/air ratio emitted from each aperture 104 is within 3.0% of the mean fuel/air ratio of all the apertures 104. The arrangement has been tested and has produced NOx and CO exhaust emissions of less that 10 vppm throughout its full operating power range, ie at temperatures in the secondary combustion zone of 1600° K. to 1750° K.

A feature of the invention is that the adjacent mixing ducts share a common wall. The walls 94 separating the individual secondary fuel and air mixing ducts 88 extend from the secondary air intake 98 at their upstream ends all the way to the frustoconical portion 62 and the walls 94 are secured to the frustoconical portion 62. Also the walls 94 extend radially between and are secured to both the annular walls 90 and 92. Thus the secondary fuel and air mixing ducts 88 are completely separated mechanically by the walls 94.

The use of the secondary annular mixing duct which is subdivided by radially extending walls 94 creates uniform fuel and air mixtures, independent of upstream air maldistributions. The fuel and air mixture is injected as discrete jets into the secondary combustion zone 52. The secondary annular mixing duct subdivided by the radially extending walls 94 creates the minimum amount of blockage and flow disturbance to the airflow around the combustion chamber. This is of particular importance to the tubular combustion chambers whose axis are arranged in generally radial directions, because the air flow has to turn through 180°. This arrangement of the secondary fuel and air mixing ducts 88 has a minimum diameter increase greater than the primary combustion zone 52, to create the maximum annular flow area between the outer annular wall 90 of the secondary fuel and air mixing duct 88 and the cylindrical casing 66 in the chambers 72. The air flow to the secondary fuel and air mixing ducts 88 in the chamber 72 is counter to the flow in the secondary fuel and air mixing ducts 88, and the air flow in the chamber 72 is at a low velocity to create a high flow acceleration into the secondary fuel and air mixing ducts 88 in order to prevent flow separation as the air flow turns through 180°.

Figure 6:
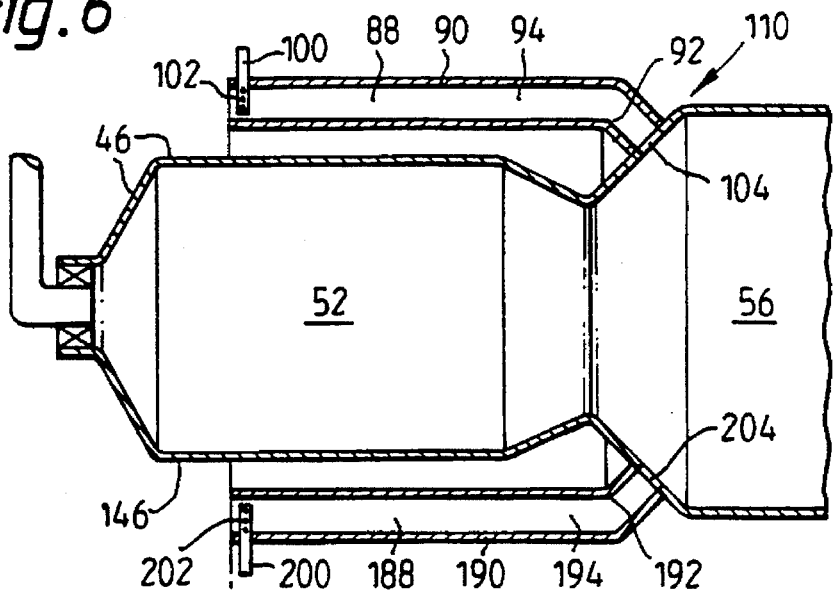
FIG. 6 is an enlarged longitudinal cross-sectional view through an alternative combustion chamber assembly according to the present invention.

The invention has been described with reference to staged combustion in tubular combustion chambers, it may also be applied to staged combustion in annular combustion chambers as shown in FIG. 6. An annular combustion chamber 110 has an annular primary combustion zone 52 and an annular secondary combustion zone 56 defined between a radially outer annular wall 46 and a radially inner annular wall 146. A plurality of secondary fuel and air mixing ducts 88 are arranged in a first annulus radially outwardly of the annular primary combustion zone 52 and a plurality of secondary fuel and air mixing ducts 88 arranged in a second annulus radially inwardly of the annular primary combustion zone 52. The secondary fuel and air mixing ducts 88 are defined between two annular walls 90 and 92 and by walls 94 extending radially between the walls 90 and 92. A fuel injector 100 is positioned at the upstream end of each secondary fuel and air mixing duct 88, and extends radially with respect to the axis of the combustion chamber 110. The secondary fuel and air mixing ducts 188 are defined between two annular walls 190 and 192 and by walls 194 extending radially between the walls 190 and 192. A fuel injector 200 is positioned at the upstream end of each secondary fuel and air mixing duct 188, and extends radially with respect to the axis of the combustion chamber 110. Each of the secondary fuel and air mixing ducts 88 communicates via a respective aperture 104 in the annular wall 46 to allow the fuel and air mixture to flow into the secondary combustion zone 56. The apertures 104 are of equal flow area. Each of the secondary fuel and air mixing ducts 188 communicates via a respective aperture 204 in the annular wall 146 to allow the fuel and air mixture to flow into the secondary combustion zone 56. The apertures 204 are of equal flow area.

Figure 7:
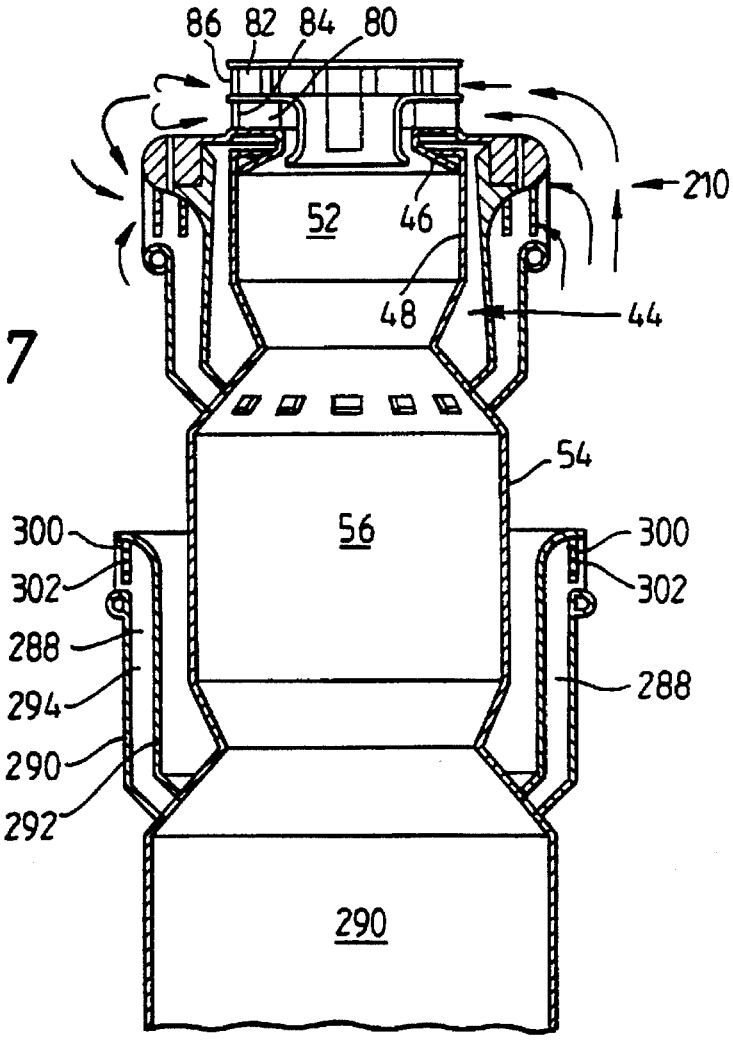
FIG. 7 is an enlarged longitudinal cross-sectional view through a further alternative combustion chamber assembly according to the present invention.

The invention is also applicable to the tertiary stage of three stage combustion chamber as shown in FIG. 7. A tubular combustion chamber 210 has a plurality of tertiary fuel and air mixing ducts 288 arranged in an annulus radially outwardly of a tertiary combustion zone 290. The tertiary fuel and air mixing ducts 288 are defined between two annular walls 290 and 292 and by walls 294 extending radially between the walls 290 and 292. A fuel injector 300 is positioned at the upstream end of each tertiary fuel and air mixing duct 288, and extends axially with respect to the axis of the combustion chamber 210. Each of the tertiary fuel and air mixing ducts 288 communicates via a respective aperture 304 in the annular wall 46 to allow the fuel and air mixture to flow into the tertiary combustion zone 290. The apertures 304 are of equal flow area.

The invention has been described with reference to tubular and annular combustion chambers, but the invention is applicable to combustion chambers of other shapes. The secondary fuel and air mixing ducts need not be positioned around the primary combustion zone and the tertiary fuel and air mixing ducts need not be positioned around the secondary combustion zone.

Figure 8:
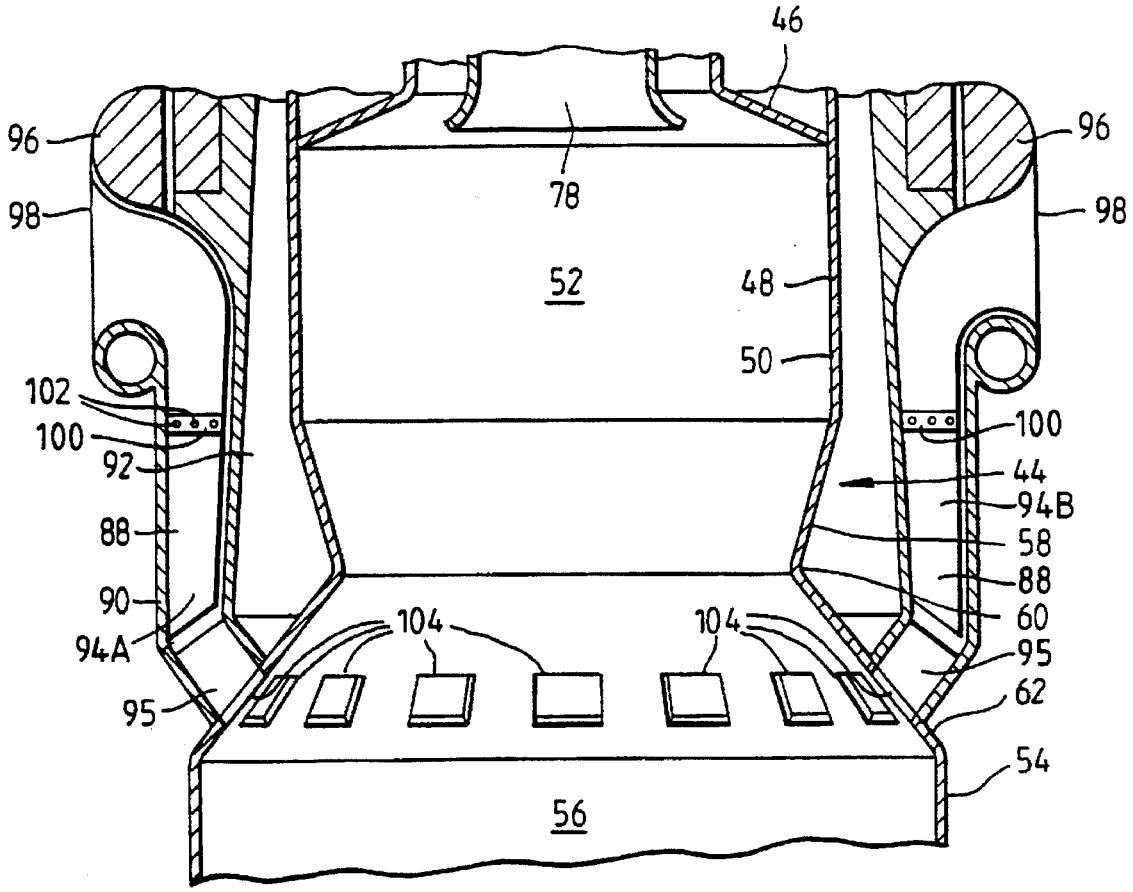
FIG. 8 is an alternative longitudinal cross-sectional view through the upstream end of the combustion chamber assembly shown in FIG. 2.

In a further embodiment, shown in FIG. 8, the walls 94 of the secondary fuel and air mixing ducts 88 do not extend the full distance to the frustoconical portion 62. Deflecting member 95 are secured to the annular walls 90 and 92 to direct the fuel and air mixture at the appropriate angle through the apertures 104 into the secondary combustion zone 56. The walls 94 extend a sufficient distance from the intakes 98 towards the members 95 to aerodynamically separate the airflows, such that there are no, or insignificant, mass flows between adjacent secondary fuel and air mixing ducts 88, ie the walls 94 must extend a sufficient distance to control the flow of air. Similarly the walls 94 do not extend the full radial distance between the annular walls 90 and 92. The walls 94 extend a sufficient distance from one of the annular walls 90 or 92 respectively towards the other annular wall 92 or 90 respectively to aerodynamically separate the airflows, such that there are no, or insignificant, mass flows between adjacent secondary fuel and air mixing ducts 88. FIG. 8 shows one wall 94A secured to the annular wall 90 and one wall 94B secured to the other annular wall 92. The mass flow rate through the secondary fuel and air mixing ducts 88 is such that the air and fuel cannot turn through the gaps between the walls 94 and annular walls 90 and 92 or deflecting members 95.

Also the fuel injectors 100 in FIG. 8 are located at a position spaced from the intake 98. The fuel injectors 100 may be located at any position along the secondary air and fuel mixing ducts 88 which produces acceptable mixing of the fuel and air. The fuel injectors 100 must be downstream of the intakes 98, and there must be a sufficient distance between the fuel injectors 100 and the apertures 104 to give the required mixing. The fuel injectors 100 must be downstream of the intakes 100 so that the fuel is supplied into the airflow after it has been divided into the individual secondary fuel and air mixing ducts 88 in order to obtain the required fuel to air ratio at the aperture 104 of each duct.

Thus it can be seen that the invention provides a number of secondary fuel and air mixing ducts for premixing the fuel and air before it is supplied into the secondary combustion zone. The main feature of these premixing ducts is that their outlets into the secondary combustion zone are of substantially the same flow area, and thus each secondary fuel and air premixing duct has substantially the same flow rate of air therethrough. Furthermore the fuel injectors for each of the secondary fuel and air mixing ducts are arranged to supply substantially the same flow rate of fuel. Thus the fuel to air ratio of the mixture leaving each of the secondary fuel and air mixing ducts is substantially the same. Similarly each of the tertiary fuel and air mixing ducts have substantially the same outlet flow area, substantially the same air flow rate, and substantially the same flow rate of fuel supplied to it.

The invention also provides that the outlets of the secondary fuel and air mixing ducts may have different flow areas and thus different air flow rates. In this case the secondary fuel injectors have their fuel flow rates adjusted so that the fuel to air ratio of the mixture leaving each of the secondary fuel and air mixing ducts is substantially the same.

We claim:

1. A gas turbine engine combustion chamber (44) comprising a primary combustion zone (52) defined by at least one peripheral wall (48) and an upstream end wall (46) connected to the upstream end of the at least one peripheral wall (48), the upstream end wall (46) has at least one aperture (78), primary air intake means (80,82) and primary fuel injector means (84,86) to supply air and fuel respectively through the at least one aperture (78) into the primary combustion zone (52), a secondary combustion zone (56) in the interior of the combustion chamber (44) downstream of the primary combustion zone (52), means (90,92,94) to define a plurality of secondary fuel and air mixing ducts (88), each secondary fuel and air mixing duct (88) has secondary air intake means (98) at its upstream end (96) to supply air into the secondary fuel and air mixing duct (88), each secondary fuel and air mixing duct (88) has secondary fuel injector means (100) arranged to supply fuel into the secondary fuel and air mixing duct (88), each secondary fuel injector means (100) is located downstream of the secondary air intake means (98) of the associated secondary fuel and air mixing duct (88), each secondary fuel and air mixing duct (88) has an outlet (104) at its downstream end for discharging the fuel and air mixture into the secondary combustion zone (56), characterised in that the outlets (104) of the secondary fuel and air mixing ducts (88) have substantially equal flow areas to produce substantially the same air flow rate through each of the secondary fuel and air mixing ducts (88), the secondary fuel injector means (100) of each secondary fuel and air mixing duct (88) is arranged to supply substantially the same flow rate of fuel so that the fuel to air ratio of the mixture leaving each of the secondary fuel and air mixing ducts (88) is substantially the same.

2. A combustion chamber as claimed in claim 1 in which the secondary fuel and air mixing ducts (88) are arranged in an annulus outside the peripheral wall (48), the secondary fuel and air mixing ducts (88) are defined by a radially inner annular wall (92), a radially outer annular wall (90) and a plurality of walls (94) extending radially between the pair of annular walls (90,92), the radially extending walls (94) are secured to at least one of the pair of annular walls (90,92).

3. A combustion chamber as claimed in claim 2 in which the secondary fuel and air mixing ducts (88) are arranged around the combustion chamber (44).

4. A combustion chamber as claimed in claim 2 in which the combustion chamber is tubular, the peripheral wall (48) of the primary combustion zone (52) is annular and the upstream end wall (46) has a single aperture (78), the secondary fuel and air mixing ducts (88) are arranged around the primary combustion zone (52), said plurality of secondary fuel and air mixing ducts (88) being arranged circumferentially in an annulus radially outwardly of the annular wall (48) of the primary combustion zone (52).

5. A combustion chamber as claimed in claim 2 in which the combustion chamber (110) is annular, the primary combustion zone (52) is annular, the annular primary combustion zone (52) is defined by a first annular wall (148), a second annular wall (146) arranged radially inwardly of the first annular wall (148), and the upstream end wall (46), the first and second annular walls (148,146) are secured at their upstream ends to the upstream end wall (46), the upstream end wall (46) has a plurality of apertures, a plurality of secondary fuel and air mixing ducts (88) are arranged around the first annular wall (148) of the primary combustion zone (52).

6. A combustion chamber as claimed in claim 2 in which the combustion chamber (110) is annular, the primary combustion zone (52) is annular, the annular primary combustion zone (52) is defined by a first annular wall (48), a second annular wall (146) arranged radially inwardly of the first annular wall (48), and the upstream end wall (46), the first and second annular walls (48,146) are secured at their upstream ends to the upstream end wall (46), the upstream end wall (46) has a plurality of apertures, a plurality of secondary fuel and air mixing ducts (188) are arranged within the second annular wall (146) of the primary combustion zone (52).

7. A combustion chamber as claimed in claim 2 in which said plurality of secondary fuel and air mixing ducts (88) are arranged circumferentially in a first annulus radially outwardly of the primary combustion zone (52), the secondary fuel and air mixing ducts (88) being defined at their radially inner extremity and radially outer extremity by a first pair of annular walls (90,92) and a plurality of walls (94) extending radially between the first pair of annular walls (90,92), and said plurality of secondary fuel and air mixing ducts being arranged circumferentially in a second annulus radially inwardly of the primary combustion zone (52), the secondary fuel and air mixing ducts (188) being defined at their radially inner extremity and radially outer extremity by a second pair of annular walls (190,192) and a plurality of walls (194) extending radially between the second pair of annular walls (190,192).

8. A combustion chamber as claimed in any of claims 1 to 7 in which at least one of the secondary fuel injector means (100) comprises a hollow cylindrical member, the hollow cylindrical member has a plurality of apertures (102) spaced apart axially along the cylindrical member to inject fuel into the secondary fuel and air mixing duct (88).

9. A combustion chamber as claimed in claim 8 in which the hollow cylindrical member extends axially with respect to the axis of the combustion chamber (44).

10. A combustion chamber as claimed in claim 9 in which the hollow cylindrical member extends radially with respect to the axis of the combustion chamber (44).

11. A combustion chamber as claimed in claim 9 in which the apertures (102) in the hollow cylindrical member are arranged to direct the fuel circumferentially.

12. A combustion chamber as claimed in claim 2 in which the walls (94) extending radially between the annular walls (90,92) are secured to both the annular walls (90,92).

13. A combustion chamber as claimed in claim 1 in which the secondary fuel injector means (100) for at least one of the secondary fuel and air mixing ducts (88) comprises two secondary fuel injectors.

14. A combustion chamber as claimed in claim 13 in which the two secondary fuel injectors (100) are spaced apart radially relative to the axis of the combustion chamber (44).

15. A combustion chamber as claimed in claim 1 in which each secondary fuel injector (100) is arranged to supply fuel to the upstream end of the associated secondary fuel and air mixing duct (88).

16. A combustion chamber as claimed in claim 1 including means (290,292,294) to define a plurality of tertiary fuel and air mixing ducts (288), each tertiary fuel and air mixing duct (288) is in fluid flow communication at its downstream end with a tertiary combustion zone (286) in the interior of the combustion chamber (44) downstream of the secondary combustion zone (56), each tertiary fuel and air mixing duct (288) has tertiary air intake means at its upstream end to supply air into the tertiary fuel and air mixing duct (288), each tertiary fuel and air mixing duct (288) has tertiary fuel injector means (300) arranged to inject fuel into the tertiary fuel and air mixing duct (288).

17. A combustion chamber as claimed in claim 16 in which the tertiary fuel and air mixing ducts (288) are arranged in an annulus outside the peripheral wall (48), the tertiary fuel and air mixing ducts (288) are defined by a radially inner annular wall (292), a radially outer annular wall (290) and a plurality of walls (294) extending radially between the pair of annular walls (290,292), the radially extending walls (294) are secured to at least one of the pair of annular walls (290,292), each tertiary fuel injector means (300) is located downstream of the tertiary air intake means of the associated tertiary fuel and air mixing duct (288), each tertiary fuel and air mixing duct (288) has an outlet at its downstream end for discharging the fuel and air mixture into the tertiary combustion zone (290), the outlets of the tertiary fuel and air mixing ducts (288) have substantially equal flow areas to produce substantially the same air flow rate through each of the tertiary fuel and air mixing ducts (288), the tertiary fuel injector means (300) of each tertiary fuel and air mixing duct (288) is arranged to supply substantially the same flow rate of fuel so that the fuel to air ratio of the mixture leaving each of the tertiary fuel and air mixing ducts (288) is substantially the same.

18. A combustion chamber as claimed in claim 17 in which the tertiary fuel and air mixing ducts (288) are arranged around the combustion chamber (210).

19. A combustion chamber as claimed in claim 17 in which the combustion chamber (210) is tubular, the peripheral wall (48) of the primary combustion zone (52) is annular and the upstream end wall (46) has a single aperture, the plurality of tertiary fuel and air mixing ducts (288) are arranged circumferentially in an annulus radially outwardly of the secondary combustion zone (56).

20. A combustion chamber as claimed in any of claims 16 to 19 in which at least one of the tertiary fuel injector means (300) comprises a hollow cylindrical member, the hollow cylindrical member has a plurality of apertures (302) spaced apart axially along the cylindrical member to inject fuel into the tertiary fuel and air mixing duct (288).

21. A combustion chamber as claimed in claim 20 in which the hollow cylindrical member extends axially with respect to the axis of the combustion chamber (210).

22. A combustion chamber as claimed in claim 20 in which the hollow cylindrical member extends radially with respect to the axis of the combustion chamber (210).

23. A combustion chamber as claimed in claim 21 in which the apertures (302) in the hollow cylindrical member are arranged to direct the fuel circumferentially.

24. A combustion chamber as claimed claim 16 in which the tertiary fuel injector means (300) for at least one of the tertiary fuel and air mixing ducts (288) comprises two tertiary fuel injectors.

25. A combustion chamber as claimed in claim 24 in which the two tertiary fuel injectors (300) are spaced apart radially relative to the axis of the combustion chamber (210).

26. A combustion chamber as claimed in claim 17 in which the radially extending walls (294) are secured to both the annular walls (290,292).

27. A gas turbine engine combustion chamber (210) comprising a primary combustion zone (52) defined by at least one peripheral wall (48) and an upstream end wall (46) connected to the upstream end of the at least one peripheral wall (48), the upstream end wall (46) has at least one aperture (78), primary air intake means (80,82) and primary fuel injector means (84,86) to supply air and fuel respectively through the at least one aperture (78) into the primary combustion zone (52), a secondary combustion zone (56) defined by a downstream portion of the at least one peripheral wall (48), the secondary combustion zone (56) is in the interior of the combustion chamber (210) downstream of the primary combustion zone (52), secondary air intake means (98) and secondary fuel injector means (100) to supply air and fuel respectively into the secondary combustion zone (56), means to define a plurality of tertiary fuel and air mixing ducts (288), each tertiary fuel and air mixing duct (288) is in fluid flow communication at its downstream end with a tertiary combustion zone (286) in the interior of the combustion chamber downstream of the secondary combustion zone (56), each tertiary fuel and air mixing duct (288) has tertiary air intake means at its upstream end to supply air into the tertiary fuel and air mixing duct (288), each tertiary fuel and air mixing duct (288) has tertiary fuel injector means (300) arranged to supply fuel into the tertiary fuel and air mixing duct (288), each tertiary fuel injector means (300) is located downstream of the tertiary air intake means of the associated tertiary fuel and air mixing duct (288), characterised in that each tertiary fuel and air mixing duct (288) has an outlet at its downstream end for discharging the fuel and air mixture into the tertiary combustion zone (290), the outlets of the tertiary fuel and air mixing ducts (288) have substantially equal flow areas to produce substantially the same air flow rate through each of the tertiary fuel and air mixing ducts (288), the tertiary fuel injector means (300) of each tertiary fuel and air mixing duct (288) is arranged to supply substantially the same flow rate of fuel so that the fuel to air ratio of the mixture leaving each of the tertiary fuel and air mixing ducts (288) is substantially the same.

28. A combustion chamber as claimed in claim 27 in which the tertiary fuel and air mixing ducts (288) are arranged around the combustion chamber (210).

29. A combustion chamber as claimed in claim 27 or claim 28 in which the tertiary fuel and air mixing ducts (288) are arranged in an annulus outside the peripheral wall (48), the tertiary fuel and air mixing ducts (288) are defined by a radially inner annular wall (292), a radially outer annular wall (290) and a plurality of walls (294) extending radially between the pair of annular walls (290,292), the radially extending walls (294) are secured to at least one of the pair of annular walls (290,292).

30. A gas turbine engine combustion chamber (44) comprising a primary combustion zone (52) defined by at least one peripheral wall (48) and an upstream end wall (46) connected to the upstream end of the at least one peripheral wall (48), the upstream end wall (46) has at least one aperture (78), primary air intake means (80,82) and primary fuel injector means (84,86) to supply air and fuel respectively through the at least one aperture (78) into the primary combustion zone (52), a secondary combustion zone (56) in the interior of the combustion chamber (44) downstream of the primary combustion zone (52), means (90,92,94) to define a plurality of secondary fuel and air mixing ducts (88), each secondary fuel and air mixing duct (88) has secondary air intake means (98) at its upstream end (96) to supply air into the secondary fuel and air mixing duct (88), each secondary fuel and air mixing duct (88) has secondary fuel injector means (100) arranged to supply fuel into the secondary fuel and air mixing duct (88), each secondary fuel injector means (100) is located downstream of the secondary air intake means (98) of the associated secondary fuel and air mixing duct (88), each secondary fuel and air mixing duct (88) has an outlet (104) at its downstream end for discharging the fuel and air mixture into the secondary combustion zone (56), characterised in that the areas of the outlets (104) of the secondary fuel and air mixing ducts (88) and the flow rate of fuel injected from the secondary fuel injector means (100) are selected such that the fuel to air ratio of the mixture leaving each of the secondary fuel and air mixing ducts (88) is substantially the same.

31. A combustion chamber as claimed in claim 30 in which the outlets (104) of the secondary fuel and air mixing ducts (88) have substantially equal flow areas to produce substantially the same air flow rate through each of the secondary fuel and air mixing ducts (88), the secondary fuel injector means (100) of each secondary fuel and air mixing duct (88) is arranged to suppply substantially the same flow rate of fuel.

* * * * *